US007206381B2

(12) United States Patent
Shimono et al.

(10) Patent No.: US 7,206,381 B2
(45) Date of Patent: Apr. 17, 2007

(54) X-RAY EQUIPMENT

(75) Inventors: Takashi Shimono, Kuroiso (JP); Katsunori Shimizu, Nasu-gun (JP)

(73) Assignees: Toshiba Electron Tube & Devices Co., Ltd., Otawara-shi (JP); Kabushiki Kaisha Toshiba, Tokyo (JP)

( * ) Notice: Subject to any disclaimer, the term of this patent is extended or adjusted under 35 U.S.C. 154(b) by 15 days.

(21) Appl. No.: 10/507,204

(22) PCT Filed: Jan. 9, 2004

(86) PCT No.: PCT/JP2004/000120

§ 371 (c)(1),
(2), (4) Date: Sep. 14, 2004

(87) PCT Pub. No.: WO2004/064106

PCT Pub. Date: Jul. 29, 2004

(65) Prior Publication Data

US 2005/0141669 A1 Jun. 30, 2005

(30) Foreign Application Priority Data

Jan. 10, 2003 (JP) ..... 2003-004674

(51) Int. Cl.
*H01J 35/14* (2006.01)

(52) U.S. Cl. ..... 378/138; 378/137

(58) Field of Classification Search ..... 378/119, 378/124, 131, 135, 137–139
See application file for complete search history.

(56) References Cited

U.S. PATENT DOCUMENTS 4,048,496 A * 9/1977 Albert ..... 378/45
4,229,657 A * 10/1980 Bensussan et al. ..... 378/125
6,292,538 B1 * 9/2001 Hell et al. ..... 378/137
6,778,633 B1 * 8/2004 Loxley et al. ..... 378/113

FOREIGN PATENT DOCUMENTS

| | | |
|---|---|---|
| JP | 12-9630 | 7/1937 |
| JP | 37-5501 | 6/1962 |
| JP | 138763/1974 | 11/1974 |
| JP | 60-400 | 1/1985 |
| JP | 3-22331 | 1/1991 |
| JP | 6-188092 | 7/1994 |
| JP | 2002-528878 | 9/2002 |
| JP | 2002-334676 | 11/2002 |
| JP | 2002-540581 | 11/2002 |

* cited by examiner

*Primary Examiner*—Edward J. Glick
*Assistant Examiner*—Hoon Song
(74) *Attorney, Agent, or Firm*—Oblon, Spivak, McClelland, Maier & Neustadt, P.C.

(57) ABSTRACT

An x-ray tube (1) irradiates an electron beam from a cathode (18) to impact a target (36) and emit x-rays. When the x-ray tube (1) operates, the magnet portion (40) is rotated every fixed time period and positioned at a prescribed rotation position. Due to the rotation of the magnet portion (40), the magnetic field formed by the permanent magnets (42) changes and the irradiation position on the target (36) of the electron beam moves. As a result, the electron beam is irradiated at a new position on the target (36) and the same amount of x-ray as the initial performance is generated.

4 Claims, 4 Drawing Sheets

X-RAY EQUIPMENT

TECHNICAL FIELD

The present invention relates to an x-ray apparatus which irradiates an electronic beam onto a target and causes x-rays to be generated.

BACKGROUND ART

Conventionally, known examples of x-ray apparatuses include a transmission type microfocus x-ray generating tube (simply referred to as x-ray tube hereinafter) used in microfocus x-ray generating devices. This x-ray tube has large magnifying power and is super precise because it is small and thus the object being examined and the x-ray can be brought close together.

However, in this type of x-ray tube, the target is irradiated with an electron beam and x-rays are generated, and when the high power electron beam is irradiated on the small area of the target, most of the energy of the electron beam converts to heat, and target deterioration and the service life of the target are problematic. As a result, the transmission microfocus x-ray generating apparatus was configured such that the device can be opened, but the target must be replaced periodically, and the structure is large and complex and also costly.

In recent years, seal-off x-ray tubes have been developed which are small and have a simple structure. However, the service life is short because of thermal deterioration of the target, and the size of the focal point is 5 μm, and an input of about 2 W is the maximum for the target.

Thus, a known example of a structure for extending the service life of the target is one wherein: a cathode which irradiates an electron beam and a target which is irradiated by the electron beam from this target and generates x-rays are disposed in a vacuum vessel; the target is disposed so to be moveable in the direction orthogonal to the axial direction of the electron beam; the target is moved by a magnet which is in outside of the vacuum vessel; the position on the target that is irradiated by the electron beam is changed and when a particular position that is irradiated by the electron beam on the target reaches its lifespan, the target is moved by a magnet and the initial performance is restored (for example, refer to Jpn. Pat. Appln. KOKAI Publication No. 3-22331 (Pages 2 to 3 and FIG. 1)).

However, in order to move the target which is inside the vacuum vessel as described above, the target itself must be made moveable and a magnet for moving the target must be provided, and thus there is the problem that the structure becomes complex.

DISCLOSURE OF INVENTION

The object of this invention is to provide an x-ray apparatus which has a simple structure and long service life.

The x-ray apparatus of an embodiment of this invention comprises a cathode which radiates an electron beam; a target which is irradiated by the electron beam and generates x-rays; and a magnet portion for moving the irradiation position of the electron beam which is irradiated onto the target. As a result, if the irradiation position on the target that was irradiated with the electron beam and generates the x-ray reaches the end of its service life, the irradiation position of the electron beam can be moved to another position of the target by rotating the magnet portion, and thus the initial performance and a long service life can be achieved.

BEST MODE OF CARRYING OUT THE INVENTION

The transmission type microfocus x-ray generating tube (simply referred to as X-ray tube hereinafter) of the microfocus x-ray generating device is described as the x-ray apparatus in the embodiment of the present invention with reference to the drawings.

Figure 1:
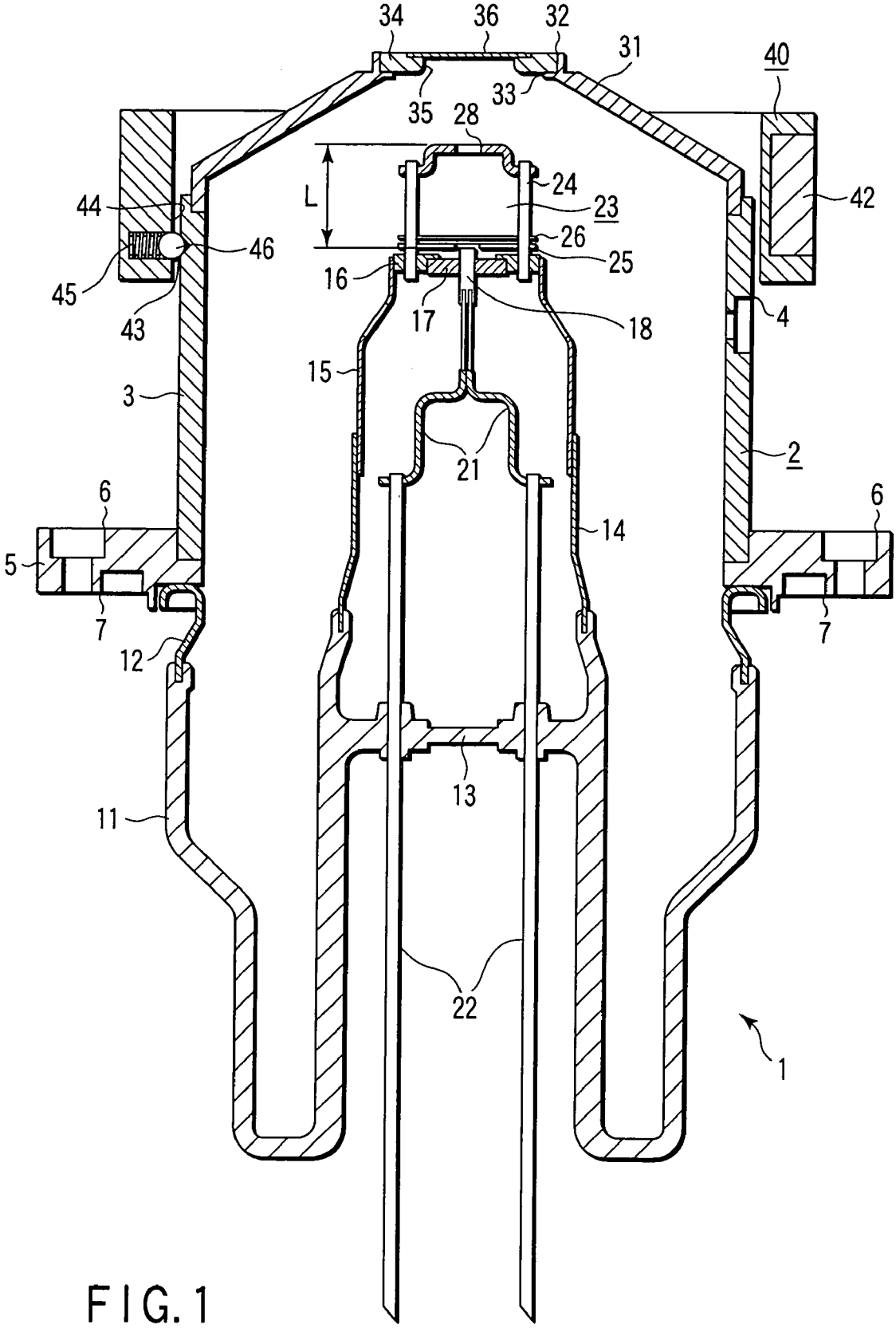
FIG. 1 is a cross-sectional view of a microfocus x-ray generating tube of an embodiment of the present invention.

FIG. 1 is a cross-sectional view of the x-ray tube 1. The x-ray tube 1 comprises a vacuum envelope 2 as the vacuum vessel which maintains vacuum tightness. The vacuum envelope 2 comprises a cylindrical cylinder portion 3, and the cylinder portion 3 has formed thereon an exhaust pipe mounting portion 4 for mounting the exhaust pipe (not shown) for vacuum exhaust. It is to be noted that the exhaust pipe mounting portion 4 is sealed off after the vacuum envelope 2 is evacuated.

The base end side of the cylinder portion 3 (lower end side in the drawing) has mounted thereto, tube mounting fitting 5 which has a circular flange shape. This tube mounting fitting 5 has a plurality of screw insertion holes 6. Screws for fixing the tube mounting fitting 5 are inserted into the screw insertion holes 6. A circular mounting groove 7 for mounting an O-ring (not shown) for preventing leakage of the cooling oil, is formed on the back surface side (lower surface side in the drawing) of the tube mounting fitting 5.

A double cylinder glass container 11 having a closed base end side is attached to the back surface side of the tube mounting fitting 5 which is the base end side of the cylinder portion 3. A circular-shape connecting body 12 which is made of metal is integrally attached to the front end of the opened outer cylinder of the glass container 11 by being welding or the like to the glass container. The connecting body 12 is welded to the tube fitting 5 and sealed so as to be air tight.

Also, a closing portion 13 for closing the inner cylinder is formed at the inner periphery side of the inner cylinder of the glass container 11. Furthermore, the circular-shape connecting body 14 which is made of metal is integrally attached to the front end of the inner cylinder of the glass container 11 by welding or the like to the glass container 11. A support body 15 is connected to the front end of the connecting body 14.

A circular plate shaped holding body 16 is attached to the front end of the support body 15. A cathode holding body 17 is attached to the inside of the holding body 16. Also, a cathode 18 is mounted to the cathode holding body 17. The cathode 18 has a built-in filament which is not shown, and this filament is heated to emit a thermal electron beam.

Furthermore, the cathode 18 has a filament support portion 21 at the base end side thereof. A filament terminal 22 which passes through the closing portion 13 of the glass container 11 in an airtight state is connected to the filament support portion 21. External power is supplied to the cathode 18 via the filament support portion 21 from the filament terminal 22.

An electrostatic focusing electrode body 23 which is the integrally formed electron lens is attached to the holding body 16. The focusing electrode body 23 and the cathode 18 form a microscopic focus electron gun.

The focusing electrode body 23 has a rod-shaped electrode holding insulation body 24 attached to the holding body 16 and also has a first focusing electrode 25, a second focusing electrode 26, and a third focusing electrode 27, formed in that order from the cathode side along the electrode holding insulation body 24. The first focusing electrode 25 applies hundreds of minus voltage. The second focusing electrode 26 applies thousands of plus voltage. The third focusing electrode 27 is disposed via a somewhat large interval with respect to the second focusing electrode 26, and applies thousands of plus voltage.

An electron beam insertion hole which is not shown is formed in the opening state in the center of the first focusing electrode 25 and the second focusing electrode 26. An electron beam insertion hole 28 which communicates linearly on the line extending from the electron beam insertion hole of the first focusing electrode 25 and the second focusing electrode 26 is formed in the center of the third focusing electrode 27.

A lid 31 in which diameter become small toward the front end is attached to the front end side of the cylinder portion 3. An attaching portion 32 which has an opening 33 is formed at the front end of the lid 31. A target holding body 34 which has an opening 35 is held at the attaching portion 32. In addition, the transmission type target 36 which will become window is attached to the target holding body 34 as a part of the vacuum envelope 2 so as to be air tight.

The target 36 is disposed so as to oppose the cathode 18 via the electron beam insertion hole of the first focusing electrode 25, the electron beam insertion hole of the second focusing electrode 26 and the electron beam insertion hole 28 of the third focusing electrode. Also, the target 36 must be formed of a plate material with little x-ray transmissivity loss such as a thin beryllium plate or an Al substrate with a thickness in the hundreds of μm so that it may function as a vacuum airtight partition. Also, a thin film of tungsten and the like with a thickness of 5 μm to 10 μm which can be the x-ray source is formed on the vacuum side of the plate material. It is to be noted that the thickness of the thin tungsten film is designed based on the depth required for passing the electron beam into the film and the attenuation rate of the generated x-ray.

Figure 2:
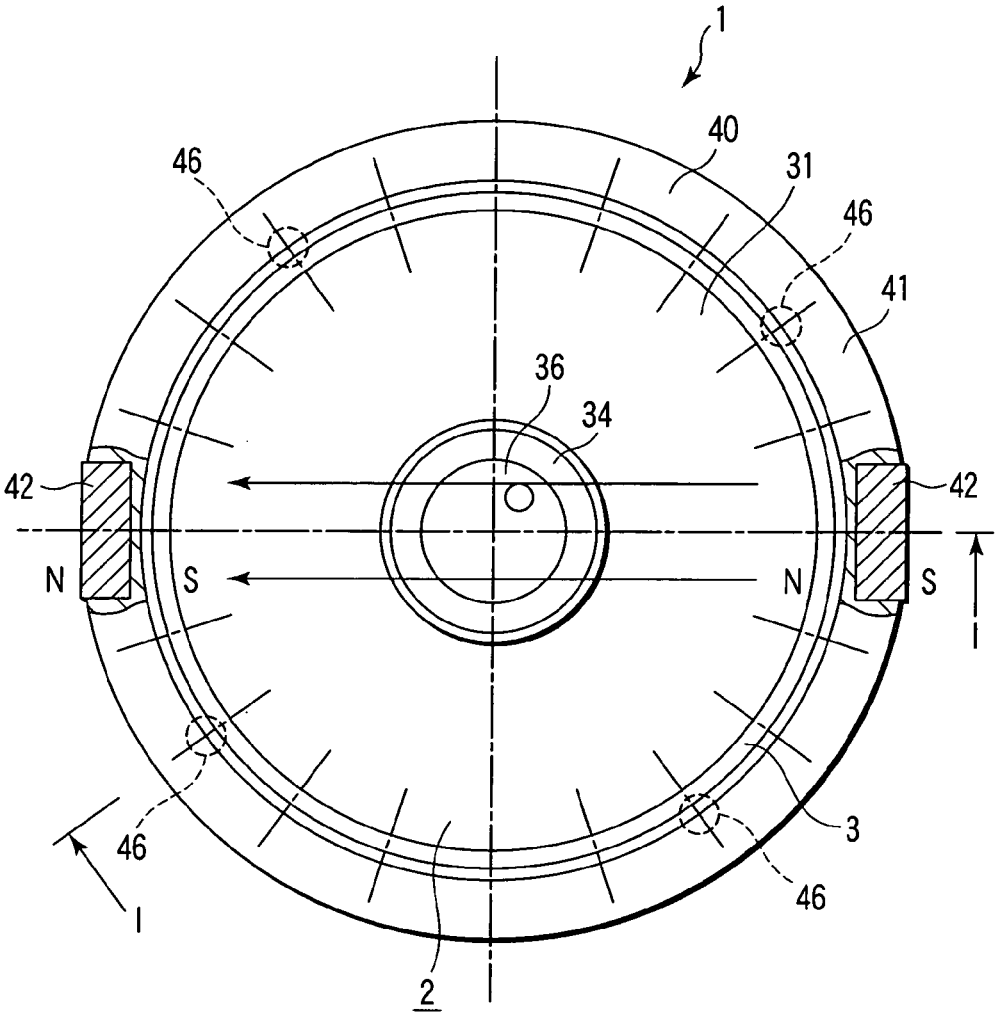
FIG. 2 is a plan view of the x-ray tube of FIG. 1.

Furthermore, as shown in FIG. 2, a magnet portion 40 is mounted to the outer periphery of the vacuum envelope 2. The magnet portion 40 has a circular magnet holding body 41 disposed via the space between itself and the vacuum envelope 2. The magnet holding body 41 is mounted so as to be manually rotatable, for example, with respect to the vacuum envelope 2. Permanent magnets 42, 42 are mounted at a position which opposes the diameter direction of the magnet holding body 41. The permanent magnets 42, 42 are disposed to have directionality when different poles oppose each other, in order to form a magnet flux with strength of approximately 10 gauss to 50 gauss in the path of the electron beam.

Figure 3:
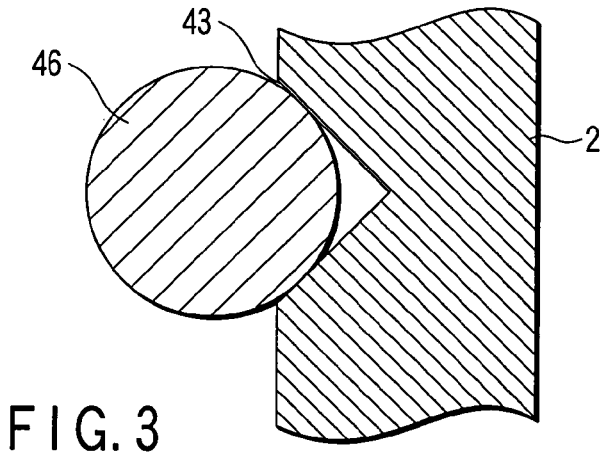
FIG. 3 is a cross-sectional view of an expanded engagement hole of the vacuum envelope of the x-ray tube of FIG. 1.

As shown in FIG. 3 also, cone-shaped engagement holes 43 are formed, for example, at 20 locations at every 18° intervals on the outer periphery of the vacuum envelope 2. On the other hand, hole grooves 44 may be formed at 4 locations at every 90° intervals at the inner periphery of the magnet holding body 41, and ball presser springs 45 are inserted into the hole grooves 44, and balls 46 for positioning sizes that can be inserted in the hole grooves 44 are attached to the front ends of the ball presser springs 45.

In addition, the ball 46 of the magnet holding body 41 is urged by the ball presser springs 45 in the central direction of the vacuum envelope 2, and the magnet holding body 41 is positioned at a prescribed rotation position by being engaged in the engagement hole 43 of the vacuum envelope 2. It is to be noted that the line extending in the diameter direction which joins the permanent magnets 42 which oppose each other, cross the axis which passes through the center of the target 36, and the axial direction position is disposed at a position which includes the range L in the FIG. 1 which extends from the front end of the cathode 18 to the third focusing electrode 27 which is at a position closest to the target 36 side.

Next, operation of the x-ray tube 1 will be described.

Firstly, the filament built into the cathode 18 is electrically heated and the cathode 18 emits a thermal electron beam. The electron beam is irradiated onto the target 36 via the focusing electrode body 23. More specifically, the electron beam which is emitted from the cathode 18 is focused with electron lens by hundreds of minus voltage from the first focusing electrode 25, and then focused further with thousands of plus voltage from the second focusing electrode 26 and the third focusing electrode 27. Voltage of approximately 100 kV is applied to the target 36 and an electron beam of 5 μm, for example, from the range of 2 μm to 5 μm is formed and focused on the vacuum side surface of target 36.

The electron beam at this time is focused at a position which is slightly offset from the center of the target 36 because of the magnetic field formed by the permanent magnets 42 in the magnet portion 40.

Due to the impact of the electron beam which is focused at the vacuum side surface of the target 36, x-rays are generated from the thin tungsten film of the target 36, and the x-rays pass through the thin beryllium plate and are sent outside and used as a x-ray source of precise testing device.

However, because several W of energy is applied to several micrometers of the diameter of the focal point, the film surface of the x-ray source such as the thin tungsten film or the like increases in temperature and deteriorates, and the amount of x-rays generated decreases with the passage of time. In addition, the thin tungsten film reaches the end of its service life after about several hundreds to one thousand hours.

As a result, within hundreds of hours which is the service life of the thin tungsten film, such as which 300 hours to 800 hours, the magnet holding body 41 of the magnet portion 40 is rotated manually or mechanically by 18° with the center of the vacuum envelope 2 as the rotation axis. When the magnet holding body 41 is rotated, the balls 46 resist the urging force of the ball presser springs 45 and are momentarily accommodated in the hole grooves 44, and then the balls 46 are urged again in the central direction of the vacuum envelope 2 by the ball presser springs 45 at the position of the adjoining engaging holes 43 and then engaged in the engaging holes 43 of the vacuum envelope 2. As a result, the rotated magnet holding body 41 is positioned at a prescribed position after being rotated by 18°.

Due to the rotation of the magnet holding body 41, the angle in the diameter direction of the magnetic field formed by the permanent magnets 42 changes, and thus the electron beam is focused not at the position at which target 36 was previously irradiated, and for example, but at a position which has shifted by 50 μm to 100 μm. By changing the focus position of the electron beam, the electron beam impacts a new position on the thin tungsten film of the target 36, and generates the same amount of x-rays as that of the initial performance. It is to be noted that, due to the rotation movement, the magnet holding body 41 can be positioned at 20 different rotation positions, and thus the irradiation position on the target 36 of the electron beam can be changed 20 times.

It is to be noted that by rotating the magnet holding body 41, the x-ray irradiation position moves sequentially from the initial position, but because the distance of movement is not more than 0.3 mm it is unnecessary to adjust the image receiving side of the test device after the x-ray is irradiated.

As described in the foregoing, in this embodiment, the magnet holding body 41 is sequentially rotated after every set time period, and thus a service life of exceeding 10,000 hours is realized in a seal-off transmission type microfocus x-ray generating tube 1 in which the size of the focal point is several μm.

Also, by increasing the magnetic strength of the permanent magnets 42, the distance of movement of the irradiation position with respect to the rotation angle of the magnet holding body 41 can be made larger, and the movement amount of the irradiation position of the electron beam can be arbitrarily set in accordance with objective of the irradiation or the size of the device. It is to be noted that in the case where a system is employed in which permanent magnets 42 are used to shift the focal point of the electron beam as in this embodiment, it is necessary to focus on the target 36 without degrading the performance of the first focusing electrode 25, the second focusing electrode 26, and the third focusing electrode 27 which form the electron lens.

In addition, the optimal position for disposing the permanent magnets 42 is set based on the strength of the permanent magnets 42, the distance of movement of the irradiation position, the diameter of the focal point, and the service life for use of the target 36. If the position of the permanent magnets 42 in the axial direction of the electron beam is between the first focusing electrode 25 and the target 36, the focus position which is to become the irradiation position may be moved, but if it is between the third focusing electrode 27 and the target 36, there is the possibility that there will be instability as the size of the focal point becomes uneven with the rotation of the magnet holding body 41, or there will be blurring at the periphery and performance will deteriorate.

Accordingly, it is important that the position in the axial direction of the electron beam of the permanent magnets 42 is between the cathode 18 and the third focusing electrode 27. As a result, there is spinning at the initial stage with respect to the electron beam emitted from the cathode 18 due to the magnetic field, and warp or blurring of the configuration of the focal point is minimized.

Next, another embodiment of the present invention will be described with reference to FIG. 4.

Figure 4:
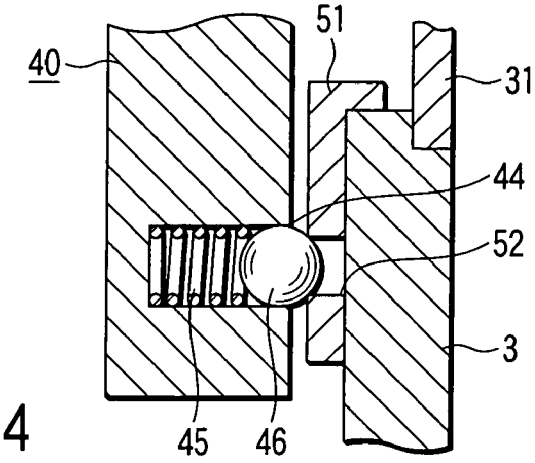
FIG. 4 is a cross-sectional view of an expanded outer fitting of an x-ray tube of another embodiment.

In the embodiment in FIG. 4, a annular outer fitting 51 which has an L-shaped cross-section is fit into the vacuum envelope 2 of the conventional x-ray tube which does not have engagement holes 43 at the outer periphery of the vacuum envelope 2, and the above-described magnet portion 40 is attached to the outer side of the outer fitting 51. The outer fitting 51 has engagement holes 52 which function in the same manner as the engagement holes 43 of the embodiment described in FIGS. 1 to 3 formed in advance therein. That is to say, by engaging the ball 46 of the magnet holding body 41 in the engaging holes 52, the magnet holding body 41 can be positioned at a prescribed rotation position.

As described above, in this embodiment, the outer fitting 51 is attached to the vacuum envelope 2 without reconstructing the x-ray tube itself and by attaching the magnet holding body 41 to the outer side of the outer fitting 51, the present invention can also be applied to the x-ray tube which does not have the conventional magnet portion 40. That is to say, in this embodiment also, the irradiation position of the electron beam on the target 36 can be moved, and the service life of the x-ray apparatus can be prolonged.

Next, yet another embodiment of the present invention will be described with reference to FIG. 5.

Figure 5:
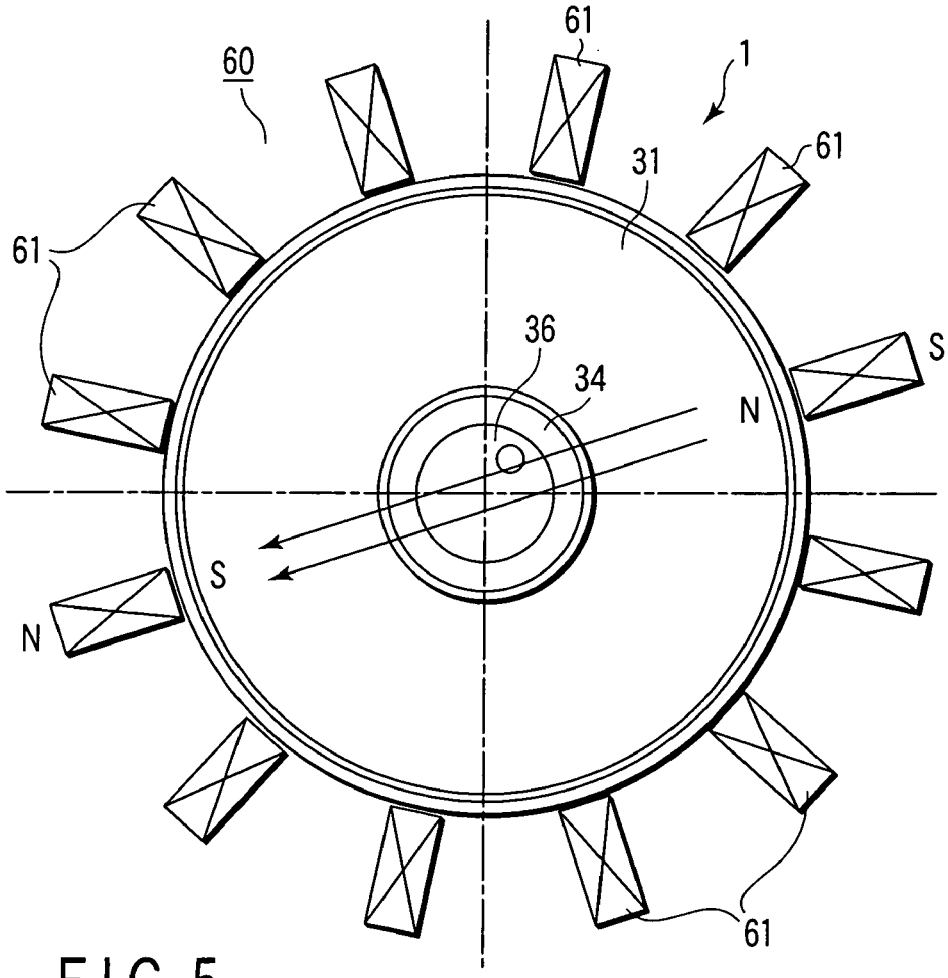
FIG. 5 is a plan view showing the x-ray tube of still another embodiment.

The embodiment shown in FIG. 5 is basically the same as the embodiment described using FIGS. 1 to 3, but the magnet portion 60 replaces the permanent magnets 42, and 12 electromagnets 61 are fixed so as to have equal intervals on the periphery of the vacuum envelope 2. Each of the electromagnets 61 can change the polar direction by changing the current direction.

When the x-ray tube 1 operates, a pair of electromagnets 61 which oppose each other in the diameter direction is selected, and this pair of electromagnets 61 is energized such that different poles oppose each other, and a magnetic field is thereby generated. In addition, when a fixed time period which is based on the service life of the target 36 elapses, the set of electromagnets 61 energized is changed, and the irradiation position on the target 36 of the electron beam is moved in the circumferential direction of the target 36. This operation is repeated and the electron beam sequentially irradiates the 12 different positions in the circumferential direction of the target 36. Furthermore, by changing the strength of the magnetic field of the electromagnet 61, the irradiation position of the electron beam may be changed to different positions in the diameter direction of the target 36.

As described above, according to this embodiment electromagnets can be selectively energized without any portions that move mechanically, and the electron beam can irradiate arbitrary positions on the target 36 only by electrical control for changing the current value, and thus the irradiation position of the electron beam can be moved. That is to say, in the present embodiment also, the service life of the x-ray apparatus can be lengthened.

It is to be noted that magnetic flux of the electromagnet 61 must have strength in a range such that the focus of the first focusing electrode 25 through to the third focusing electrode 27 are not affected thereby, and there is no negative effect on focusing.

Next, yet another embodiment of the present invention will be described with reference to FIG. 6.

Figure 6:
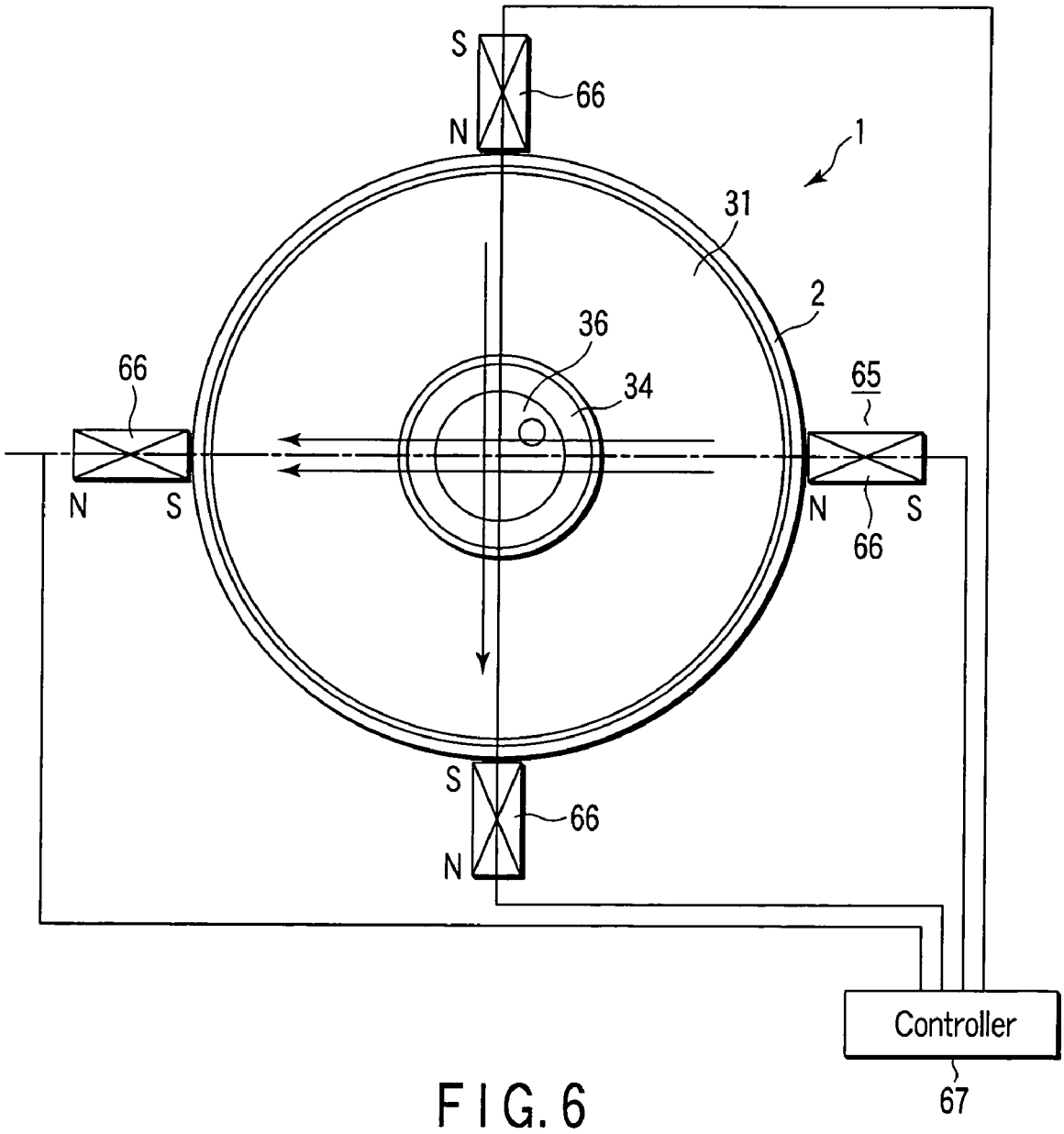
FIG. 6 is a plan view showing the x-ray tube of yet another embodiment.

The embodiment shown in FIG. 6 basically uses electromagnets in the same manner as the embodiment described refer to FIG. 5, but the magnet portion 65 is disposed such that 2 pairs of a total of four electromagnets 66 are fixed at equal intervals of 90° along the periphery of the vacuum envelope 2, and the energization of the electromagnets 66 are controlled by the control means 67.

When this x-ray tube 1 is operated, the electric energizing amount and the current direction of the 4 electromagnets 66 are controlled by the control means 67, and the direction and strength of the 2 magnetic fluxes which intersect on the tube axis are changed and arbitrary magnetic flux is synthesized. As a result, the electron beam can be irradiated on a arbitrary position of the target 36.

Accordingly, in this embodiment also, the electron beam can be irradiated on a arbitrary position of the target 36 using a smaller electromagnet 66, and the irradiation position of the electron beam can be freely moved. That is to say, in this embodiment also, the service life of the x-ray apparatus can be lengthened.

INDUSTRIAL APPLICABILITY

According to the present invention, even when the irradiation position in which an electron beam is irradiated and x-rays are generated reaches the end of its service life, the irradiation position of the electron beam can be moved to another position of the target due to the effect of a magnet portion. Thus, by changing the irradiation position to a position on the target that has not reached the end of its service life, the initial performance can be obtained and service life can be lengthened.

The invention claimed is:

1. An x-ray apparatus comprising:

a cathode which irradiates an electron beam;

a target which is irradiated by the electron beam and generates x-rays;

a plurality of pairs of opposing electromagnets between which the electron beam is interposed and which moves the irradiation position of the electron beam that is irradiated on the target;

wherein the plurality of pairs of opposing electromagnets is disposed rotatably about the axial direction of the electron beam and the irradiation position of the electron beam is changed by rotation of the plurality of pairs of opposing electromagnets; and a controller configured to energize a selected pair of electromagnets, to control the irradiation position on the target of the electron beam, and after a set time related to the service life of the target has elapsed, to energize another set of electromagnets.

2. The x-ray apparatus according to claim 1, comprising a plurality of focusing electrodes between the target and the cathode, wherein the position of the selected pair of electromagnets in the axial direction of the electron beam is between the focusing electrode which is closest to the target side and the cathode.

3. An x-ray apparatus comprising:

a cathode which irradiates an electron beam;

a target which is irradiated by the electron beam and generates x-rays;

a plurality of pairs of opposing electromagnets between which the electron beam is interposed and which moves the irradiation position of the electron beam that is irradiated on the target;

a controller configured to energize a selected pair of electromagnets, to control the irradiation position on the target of the electron beam, and after a set time related to the service life of the target has elapsed, to energize another set of electromagnets.

4. The x-ray apparatus according to claim 3, comprising a plurality of focusing electrodes between the target and the cathode, wherein the position of the selected pair of electromagnets in the axial direction of the electron beam is between the focusing electrode which is closest to the target side and the cathode.

* * * * *